US006222463B1

(12) United States Patent
Rai

(10) Patent No.: US 6,222,463 B1
(45) Date of Patent: Apr. 24, 2001

(54) VEHICLE COMMUNICATION NETWORK

(75) Inventor: Vikram Rai, Randolph, NJ (US)

(73) Assignee: Lucent Technologies, Inc., Murray Hill, NJ (US)

( * ) Notice: Subject to any disclaimer, the term of this patent is extended or adjusted under 35 U.S.C. 154(b) by 0 days.

(21) Appl. No.: 09/104,735

(22) Filed: Jun. 25, 1998

(51) Int. Cl.[7] ..... G08G 1/065

(52) U.S. Cl. ..... 340/928; 340/905; 340/988; 342/51; 455/517; 701/35

(58) Field of Search ..... 340/905, 928, 340/825.54, 933, 988; 342/51; 455/517; 701/35

(56) References Cited

U.S. PATENT DOCUMENTS

| | | | | |
|---|---|---|---|---|
| 4,001,822 | | 1/1977 | Sterzer . | |
| 4,104,630 | | 8/1978 | Chasek . | |
| 4,303,904 | | 12/1981 | Chasek | 235/384 |
| 4,339,753 | | 7/1982 | Mawhinney . | |
| 4,532,511 | | 7/1985 | Lemelson | 340/933 |
| 4,591,823 | * | 5/1986 | Horvat | 340/905 |
| 4,797,948 | | 1/1989 | Milliorn et al. | 340/991 |
| 4,937,581 | * | 6/1990 | Baldwin et al. | 235/384 |
| 5,196,846 | * | 3/1993 | Brockelsby et al. | 340/905 |
| 5,289,183 | * | 2/1994 | Hassett et al. | 340/905 |
| 5,396,233 | * | 3/1995 | Hofmann | 340/905 |
| 5,459,304 | * | 10/1995 | Eisenmann | 235/384 |
| 5,488,360 | | 1/1996 | Ray | 340/933 |
| 5,579,008 | | 11/1996 | Hulderman et al. | 342/51 |
| 5,587,575 | * | 12/1996 | Leitner et al. | 235/384 |
| 5,608,391 | | 3/1997 | Bantli et al. | 340/933 |
| 5,657,008 | | 8/1997 | Bantli | 340/933 |
| 5,661,473 | | 8/1997 | Paschal | 340/933 |

* cited by examiner

*Primary Examiner*—Brent A. Swarthout
(74) *Attorney, Agent, or Firm*—J. De La Rosa

(57) ABSTRACT

The present invention provides a bi-directional vehicle communication network which has the ability for record management and collection, including updating registration, insurance, inspection and/or maintenance records, as well as for collecting for the transaction fee or cost thereof. Additionally, the present vehicle communication network readily affords the ability of ticketing drivers for traffic violations. Importantly, vehicles are equipped with an electronic tag containing records associated therewith. In response to radio frequency signals from a portable interrogator, vehicular records may be selectively retrieved from the electronic tag. Updated records are then transmitted to the electronic tag for storage. Similarly, those updated records may be also transmitted to a centralized control center for archival purposes, as well as for effecting collection.

36 Claims, 8 Drawing Sheets

VEHICLE COMMUNICATION NETWORK

TECHNICAL FIELD

The present invention relates to a communication network and, more particularly, to a vehicle communication network for providing an integrated record management and collection system.

BACKGROUND OF THE INVENTION

In recent years, as the number of vehicles on the road has dramatically increased, there has been an increased need for a more efficient record management and collection system. Today, record management, such as for registration, insurance and inspection records, is provided by administrative agencies generally untrained or too poorly equipped to do so. For example, each department of motor vehicles (DMV) only has several employees who unfortunately are burden with the responsibilities for renewing registrations, conducting inspections, and issuing license plates and driver licenses for hundreds of vehicles and drivers a day. The DMV is as well responsible for collecting fees for most of these latter services, which for obvious reasons is time consuming.

With administrative agencies generally ill-suited to handle the latter administrative tasks, it is estimated that their efficiency is low, as no doubt evident by the long lines at the DMVs. Although allocating some of these administrative tasks to local independent service centers has been beneficial, it has not been entirely successful. Accordingly, there is a need in the art to provide for a cost-effective record management and collection system which enhances the work force utilization of today's vehicular administrative agencies.

SUMMARY OF THE INVENTION

The present invention provides a bi-directional vehicle communication network which has the ability for record management and collection, including updating registration, insurance, inspection and/or maintenance records, as well as for collecting for the transaction fee or cost thereof. Additionally, the present vehicle communication network readily affords the ability of ticketing drivers for traffic violations. Importantly, vehicles are equipped with an electronic tag containing records associated therewith. In response to radio frequency signals from a portable interrogator, vehicular records may be selectively retrieved from the electronic tag. Updated records are then transmitted to the electronic tag for storage. Similarly, those updated records may be also transmitted to a centralized control center for archival purposes, as well as for effecting record management and collection.

The network includes a control center linked to a plurality of vehicle base stations and a point of sale (POS) or automated teller machine (ATM) system. Vehicles equipped with electronic tags respond to radio frequency signals sent out by the portable interrogator when activated by an authorized person. Each vehicle base station is capable of communicating through radio communication with the portable interrogator which selectively queries the electronic tag for registration, inspection, insurance and/or maintenance records. The response of the electronic tag takes the form of encoded radio frequency signals corresponding to the desired vehicular records requested by the portable interrogator.

Preferably, both permanent and variable information are stored in memory residing within the electronic tag, such as the vehicle identification number (VIN), the make and model of the vehicle, the license plate number, as well as other registration, inspection, insurance and/or maintenance records.

In a preferred embodiment, each cell is allocated at least one cellular radio channel used to effect bidirectional communication between the portable interrogator and the vehicle base station to effect record management and collection using information transmitted to and received from the electronic tag. The portable interrogator includes a liquid crystal display (LCD) capable of displaying both data and graphics. Four keypads are used to control the functions of the portable interrogator in a menu driver fashion. Also, an alphanumeric keypad is used for entering or updating data into the portable interrogator. Updated records once entered are then transmitted to the electronic tag and the control center for storage. Such updated records may include registration, inspection, insurance, and/or maintenance records for the vehicle and may be readily displayed on the LCD to an authorized personnel.

The control center also includes a database containing registration, inspection, insurance and/or maintenance records. Advantageously, this allows control center operators to update those records for particular vehicles and later transmit such records to the electronic tag when the vehicle is taken to an authorized center. Also, control personnel may request the control center to prepare various reports for a specific vehicle or search for specific records. Notices, such as for expired registration, insurance and/or inspection, may be generated and mailed to individuals. Such capabilities enhance record management as well as minimize the amount of work performed by service personnel on administrative tasks.

In another aspect of the present vehicle communication network, if desired, the control center may also effect collection, such as for registration, repairs or traffic violations. Specifically, billing may be effected by the control center preparing and transmitting an appropriate invoice to the portable interrogator. After obtaining the driver's bank account, credit card or ATM number, the portable interrogator transmits the latter information to the control center so as to transfer funds from the driver's financial institution.

Still another unique aspect of the present vehicle communication network is the ability of ticketing drivers for traffic violations without the need for an officer to manually approach a vehicle and obtain the registration records. Advantageously, the portable interrogator may query the electronic tag for the registration records for the vehicle and then populate a standardized traffic ticket with those records.

BRIEF DESCRIPTION OF THE DRAWINGS

The features and advantages of the present invention will become more readily apparent from the following detailed description of the invention in which like elements are labeled similarly and in which.

DETAILED DESCRIPTION

The inventive vehicle communication network has the ability, among other things, for readily managing and updating registration, inspection, insurance and/or maintenance records, as well as for collecting for the transaction fee or cost thereof. Additionally, the present vehicle communication network readily affords the ability of ticketing drivers for traffic violations without the need for an officer to manually approach a vehicle and obtain the registration records. Importantly, vehicles, such as cars and trucks, as well as other related vehicles found on today's highways, are equipped with an electronic tag containing records associated with the corresponding vehicle. In response to radio frequency signals from a portable interrogator, vehicular records may be readily retrieved from the electronic tag and updated by an authorized person using the portable interrogator. The updated records are then transmitted to the electron tag for storage. Similarly, the updated records may be also transmitted to a centralized control center for archival purposes, as well as for effecting record management and collection.

The capability to integrate such services affords a highly efficient means for vehicular record management and collection. Of course, the vehicle communication network may be customized to the particular needs of administrative, insurance and law enforcement agencies, and due to the use of wireless communication, such as cellular radio communication, may be installed and used virtually anywhere in the world.

It is contemplated that the present vehicle communication network is realized by wireless communication, such as cellular radio. It is to be understood, however, that the network described below is for the purpose of illustration only and not for the purpose of limitation. Other suitable communication, whether radio, microwave or optical, may be used with the present invention.

Figure 1:
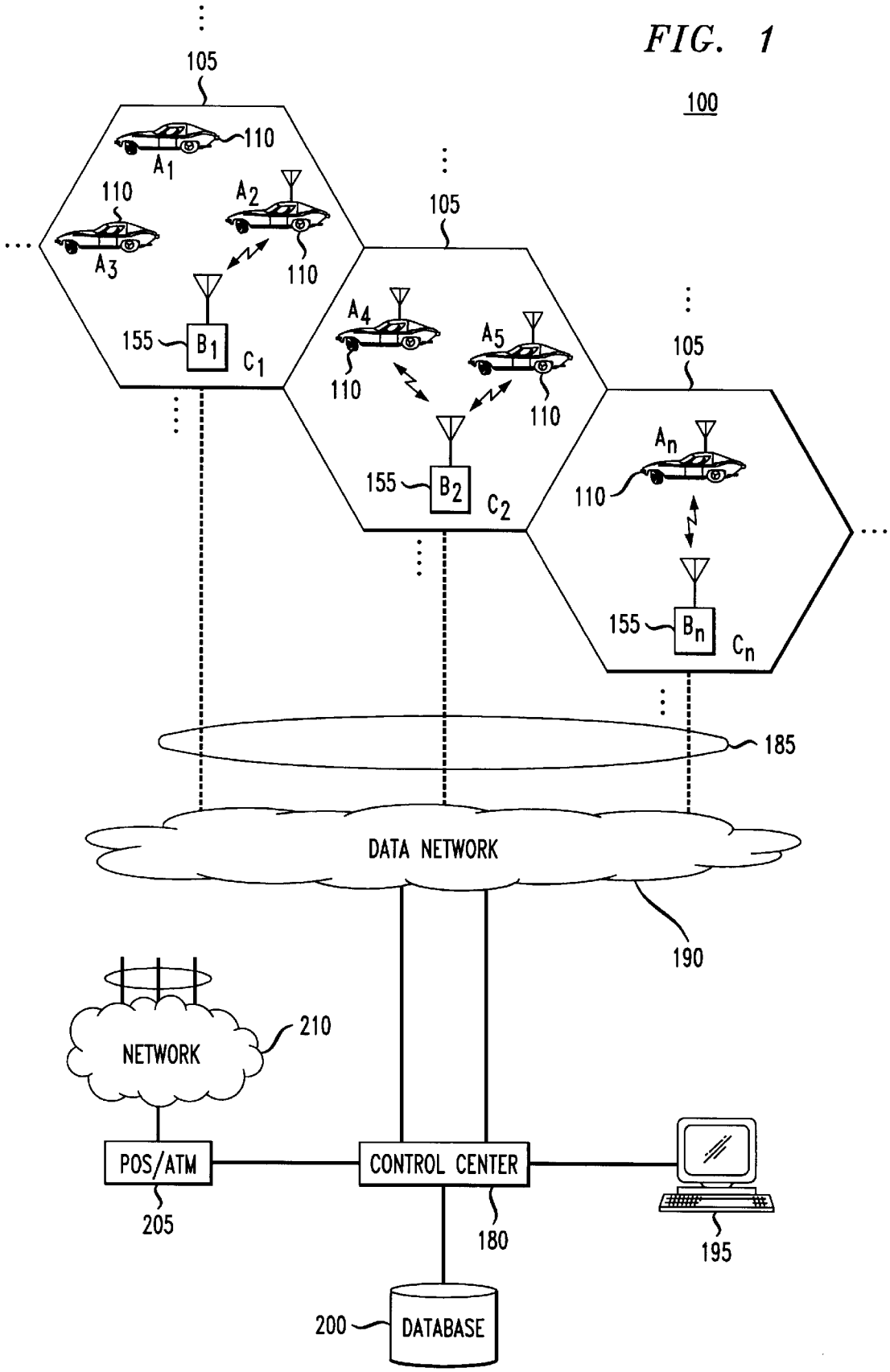
FIG. 1 is a pictorial representation of the present vehicle communication network, including a control center, a plurality of vehicle base stations, and a plurality of vehicles.
Figure 2:
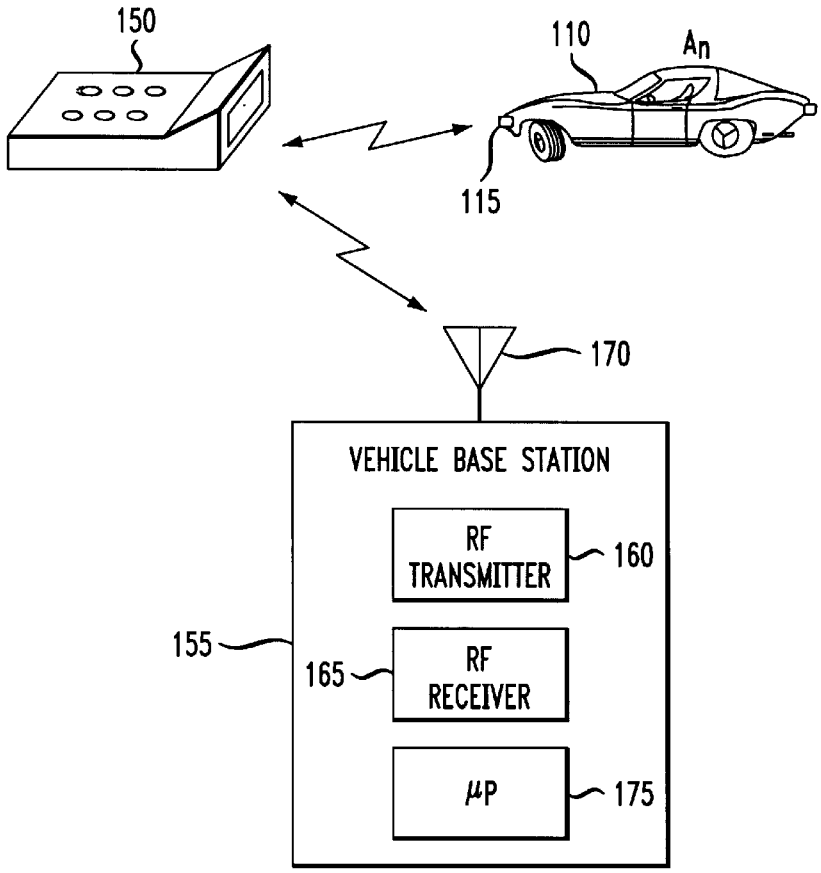
FIG. 2 is a pictorial representation of a portable interrogator communicating with an electronic tag and vehicle base station.
Figure 3:
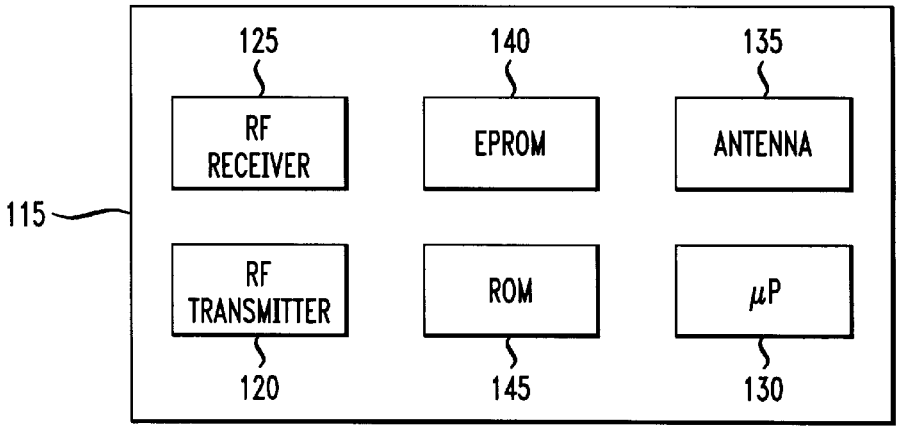
FIG. 3 is a pictorial block diagram of the electronic tag of FIG. 2.

Referring to FIGS. 1–2, there is shown in schematic block diagram a communication system 100 in accordance with the principles of the invention. An arbitrary geographic area is divided into a plurality of radio coverage areas or cells 105 ($C_1$–$C_n$). These cells may be located over wide areas of highways and roads within, for example, different cities. Within each of cells 105 ($C_1$–$C_n$) are vehicles 110 ($A_1$–$A_n$), the actual number depending on the volume of traffic within the particular cells. Each vehicle 110 ($A_1$–$A_n$) is provided with an electronic tag 115, preferably including a RF transmitter 120, a RF receiver 125, a communication microprocessor 130, an antenna 135, EPROM 140 and ROM 145, as illustrated in FIG. 3.

Electronic tag 115 responds to radio frequency signals sent out by a portable interrogator 150 when activated by an authorized person, such as a service personnel or law enforcement officer. Preferably, a personal identification number (PIN) or code must be entered prior to using portable interrogator 150. RF transmitter 120 radiates in a cone of about ten (10) degrees when queried or "pinged" by portable interrogator 150. In this manner, radio signals from other electronic tags do not interfere with signals from the desired electronic tag.

The response of electronic tag 115 takes the form of encoded radio frequency signals corresponding to the desired vehicular records requested by portable interrogator 150. The interrogation of electronic tag 115 is activated as desired by an authorized person when portable interrogator 150 is within the transmission range of electronic tag 115. Preferably, both permanent and variable information are stored in memory residing within electronic tag 115. Permanent information is stored in read-only memory (ROM) 145 and may include, for example, the vehicle identification number (VIN), and the make and model of the corresponding vehicle. Similarly, the license plate number as well as registration, inspection, insurance and/or maintenance records may be stored in electrically programmable read only memory (EPROM) 140, which likewise can be retrieved for later use. These latter records, however, may be updated annually, or as needed. To preserve the data contents of electronic tag 115, a memory back-up battery is used. Preferably, electronic tag 115 resides in the license plate, but may also reside in the trunk or dashboard of the vehicle.

Vehicle base stations 155 ($B_1$–$B_n$) may be found within respective cells 105 ($C_1$–$C_n$). Each vehicle base station 155 ($B_1$–$B_n$) is capable of communicating through cellular radio or other wireless means with portable interrogator 150 which selectively queries electronic tag 115 for registration, inspection, insurance and/or maintenance records. Likewise, each vehicle base station 155 ($B_1$–$B_n$) includes a RF transmitter 160, a RF receiver 165, an antenna 170 and a communication microprocessor 175 so as to effect cellular radio communication with portable interrogator 150. Of course, satellite, microwave or infrared communication may also be used in accordance with principles known to those skilled in the art.

Preferably, each of cells 105 ($C_1$–$C_n$) is allocated at least one cellular radio channel used to effect bidirectional communication between portable interrogator 150 and vehicle base stations 155 to effect record management, collection and ticketing using information transmitted to and received from electronic tag 115 of the corresponding vehicle. Those skilled in the art will readily note that the communication channels may operate either in an analog or a digital mode, or a combination thereof. In the digital mode, analog signals are converted to digital representations prior to transmission over a RF channel. Purely data messages, such as those generated by a microprocessor may be formatted and transmitted directly over a digital channel.

The required low-level software to effect cellular communication is readily capable of implementation by those skilled in the art. It is contemplated that such software and the like, for example, may be stored in standardized memory cards, such as a flash memory card.

Referring to FIG. 1, communication is also provided between vehicle base stations 155 ($B_1$–$B_n$)and a control center 180 through communication links 185 of a data network 190. Control center 180 may be attended by one or more trained operators through terminal(s) 195. Digital links operating at 128 Kb/sec or higher may be used as communication links 185. Data network 190 may be an integrated system digital network (ISDN) facility. In this latter instance, the X.25 protocol, may be used for facilitating the sending of message, data or records between vehicular base stations 155 ($B_1$–$B_n$)and control center 180. The X.25 protocol is well known to those of ordinary skill in the art and will not be discussed herein for the sake of clarity.

It should be understood that control center 180 includes registration, inspection and insurance database 200 used for archival as well as record management and billing purposes. In addition, each vehicle base station 155 may contain internally resident databases necessary or useful in the effecting those latter services. Control center 180 may be, for example, located within the same physical location as the cells. For extended coverage, however, a plurality of control centers linked to each other may be employed.

Portable interrogator 150 may interrogate a specific electronic tag located within a moving or stationary vehicle to transmit particular vehicular records, which records may be immediately displayed to the authorized user and/or communicated to control center 180. It is contemplated that such vehicular records can be used to identify the vehicle or used for registration, inspection, insurance, and/or maintenance purposes. Additionally, such information may be used to identify stolen cars or those used in the commission of crimes, as well as in ticketing vehicles for traffic violations, among other things. Record management may be automatically controlled by control center 180, including but not limited to the following:

Registration Renewal Notices

Inspection Renewal Notices

Outstanding Traffic Violation Notices

License Plate Query Search

Vehicle Query Search by Make, Model & Year

Expired Insurance Notices

Owner Query Search

Outstanding Traffic Violations

If desired, some of these functions may be distributed to the vehicle base stations or performed manually by a control center operator at the request of, for example, law enforcement agencies.

Vehicle communication network 100 also is preferably linked to a generic point of sale (POS) or an automated teller machine (ATM) system 205 which is linked to each of vehicle base stations 155 through data communication network 190. ATM/POS system 205 includes a POS/ATM data communication network 210. Plurality of independently operated ATM/POS systems all intercommunicate simultaneously in order to provide billing service to drivers, such as for registration renewals, maintenance, traffic violations, and the like. A clearing house data communication network also interconnects the plurality of ATM/POS systems to clearing house network centers. By transferring information among the different ATM/POS systems operated by various merchants, the clearing housing data communication network and the clearing house network centers allow direct inter-institution transactions, such as between ATM/POS system 205 and the particular ATM/POS system operated by the driver's financial institution.

Figure 4:
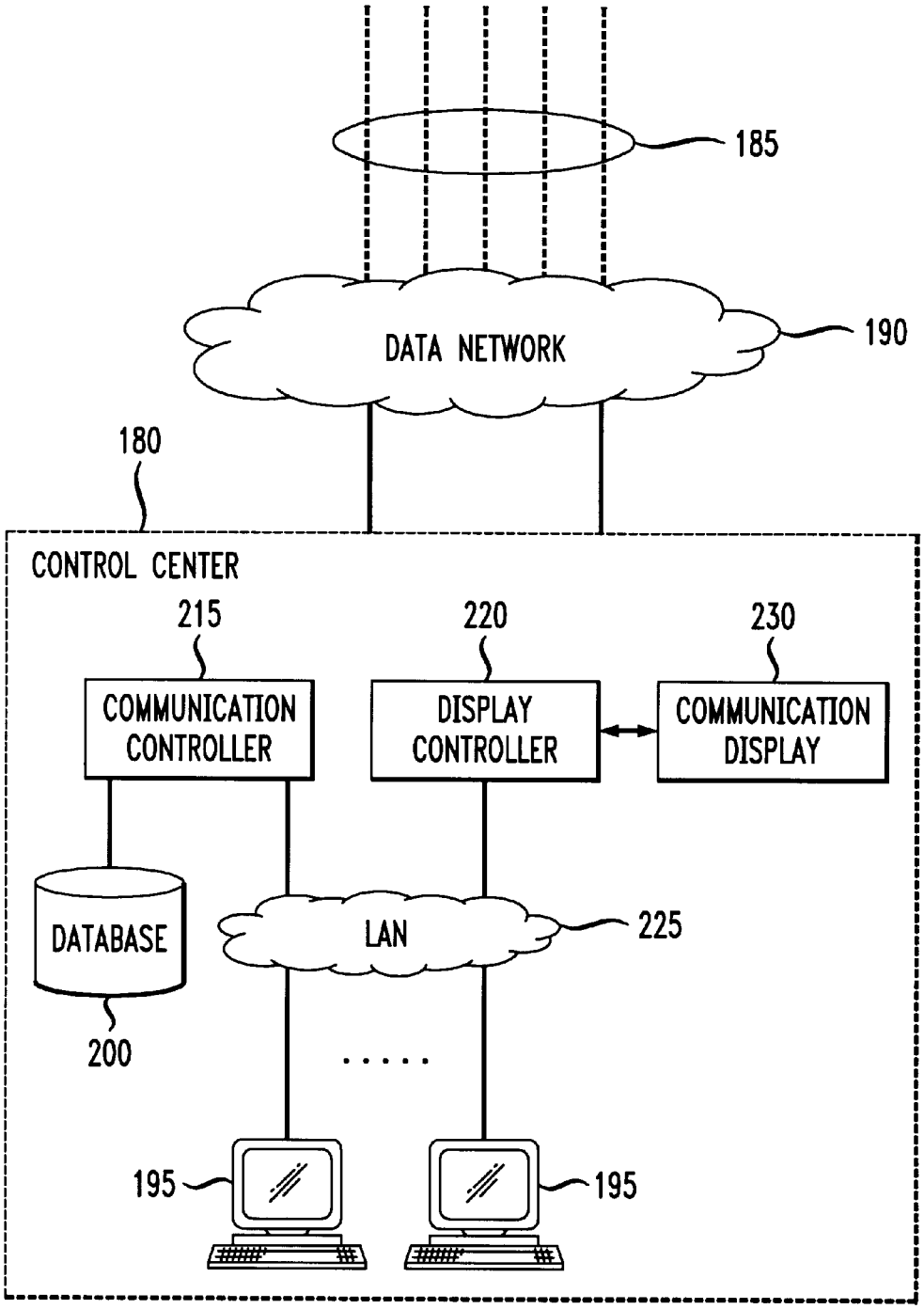
FIG. 4 is a detailed block diagram of the control center for the vehicle communication network of FIG. 1.

Referring to the illustration of FIG. 4, control center 180 may include a communication controller 215, and a display controller 220, there being a suitable conventional interface 225 therebetween. As stated above, control center 210 includes database 200 containing, for example, driver, registration, insurance and/or inspection records to effect record management. Interface 225 may be a local area network (LAN) interface, having one or more terminals 195, allowing control center operators to also enter information into database 200. Terminals 195 are understood to include any of a variety of input devices such as a keyboard, mouse, trackball, or other user interfaces.

Communication controller 215, among other things, serves as a processor and buffer between vehicle base stations 155, and display controller 220 and database 200. Data transmitted through communication controller 215 may be displayed on a communication display 230. If desired, display controller 220 may use a map to depict information regarding particular vehicles in a graphical manner, such as on pre-existing digitized maps of arbitrarily large geographical areas.

Figure 5:
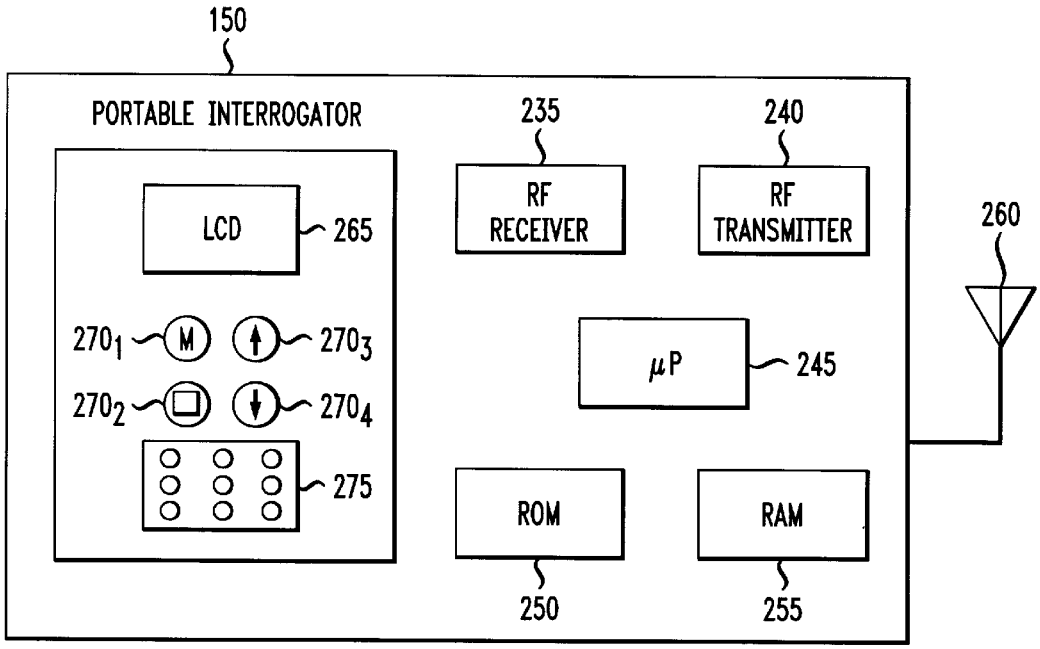
FIG. 5 is a more detailed block diagram of the portable interrogator.

Referring to FIG. 5, portable interrogator 150 likewise includes a local RF receiver 235, a RF transmitter 240, a microprocessor 245, read-only-memory (ROM) 250 and random access memory (RAM) 255. RF transmitter 240 is provided with an antenna 260 by which it communicates to electronic tag 115 and vehicle base station 155 within the cell portable interrogator 150 is located.

Furthermore, portable interrogator 150 preferably includes a LCD 265 capable of displaying both data and graphics. Also, four keypads $\mathbf{270}_{1\text{-}4}$ may be used to control the functions of portable interrogator 150 in a menu driver manner. An alphanumeric keypad 275 may be used for entering data into portable interrogator 150, such as for updating or entering records. Updated records once entered are then transmitted to electronic tag 115 and control center 180 for storage. Such updated records may include registration, inspection, insurance, and/or maintenance records for the vehicle and may be readily displayed on LCD 265 to an authorized personnel.

Figure 6:
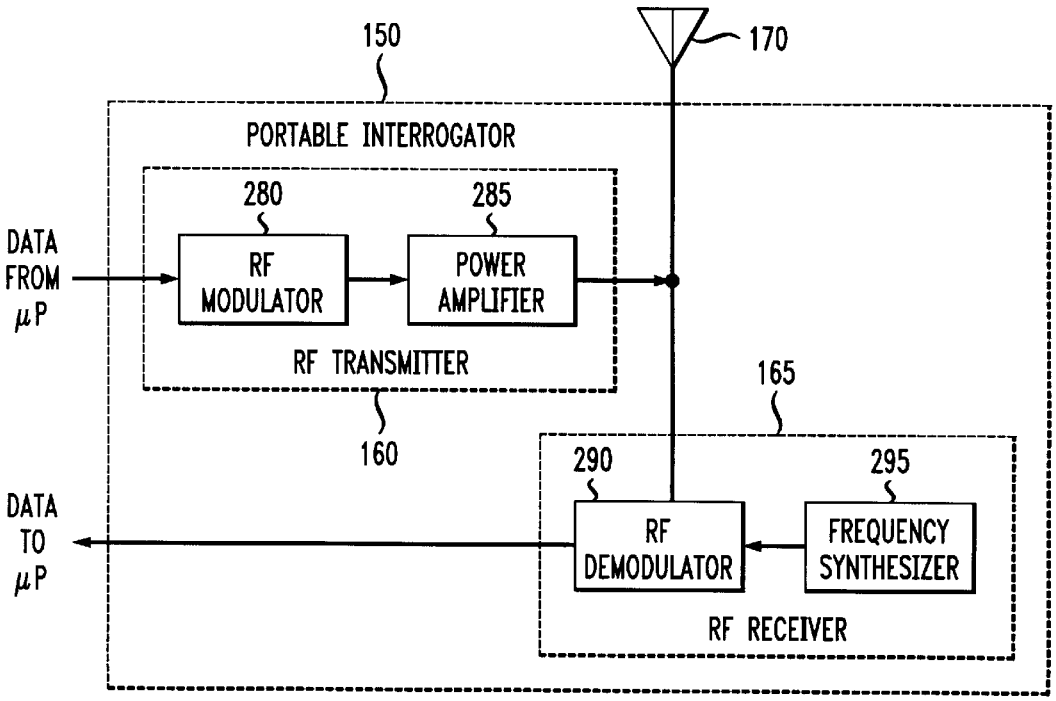
FIG. 6 is a block diagram of the transmitter and receiver portions of the portable interrogator used in accordance with the present invention.

Referring next to FIG. 6, there is shown therein a simplified schematic block diagram of portable interrogator 150 used to transmit and receive data from vehicle base stations 155 as well as electronic tag 115. Data destined for transmission to vehicle base station 155 or electronic tag 115 is divided into data packets of messages in accordance, for example, with the time division multiple access (TDMA) technique of digital communications. Those skilled in the art will readily note that other techniques may be used, such as CDMA. Data packets along with supervisory messages are time division multiplexed and provided as an input to a RF modulator 280. RF modulator 280 is used for modulating a carrier frequency in a manner well known those in the art of cellular radio communication. The modulated carrier signal output of RF modulator 280 is amplified by a power amplifier 285 and then transmitted to vehicle base station 155 or electronic tag 115 through antenna 170.

Portable interrogator 150 receives modulated RF signals from both vehicular base station 155 and electronic tag 115 through antenna 170 connected to RF receiver 165. A receiver carrier frequency for the selected receiving channel is generated by a receiving frequency synthesizer 295 and supplied to a RF demodulator 290. RF demodulator 290 is used to demodulate the received carrier signal into the original digital information. For a more detailed description on the use of cellular radio communication, see, for example, *Cellular Radio: Principles and Design*, Raymond C. V. Macario, McGraw-Hill, Inc. 1993.

Those skilled in the art will readily note that much of the equipment used by portable interrogator 150 to effect radio communication may also be used by electronic tag 115 and vehicular base station 155. Accordingly, for the sake of simplicity, that equipment will not be discussed herein. There is, however, one important difference. Vehicle base stations 155, unlike the electronic tags and the portable interrogator are preferably connected to control center 180 through high speed communication links of data network 190. It should be clearly understood that vehicle base stations 155 each includes microprocessor 175 that controls the activities of the base station and the communication to portable interrogator 150 and control center 180. Information is routed by microprocessor 175 in accordance with messages received from control center 180 or portable interrogator 150. Microprocessor 175 may also be provided with a terminal keyboard and display unit that allows information to be transmitted to electronic tag 115 or control center 180.

Figure 7:
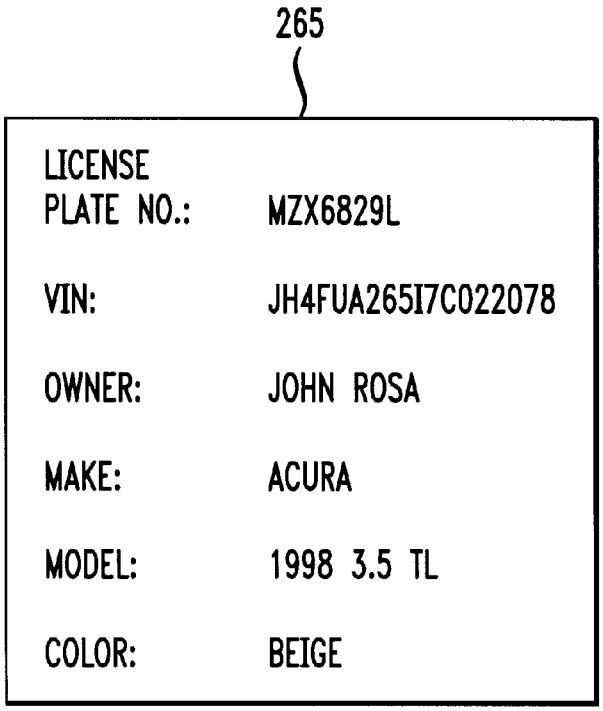
FIG. 7 is an illustrative display of records displayed on the portable interrogator.

As illustrated in FIG. 7, the license plate number, vehicle identification number (VIN), owner, make and model of the vehicle can be displayed on LCD 265, once portable interrogator 150 has queried electronic tag 115 for the desired registration records. If desired, other records can be readily retrieved and displayed on LCD 265 for the vehicle, such as inspection, insurance, and/or maintenance records.

Keypads $\mathbf{270}_{1\text{-}4}$ are used to control the functions of portable interrogator 150, with alphanumeric keypad 275 used for entering data into portable interrogator 150. Keypads $\mathbf{270}_{1\text{-}4}$ are respectively label "M" for menu, "□" for select, "↑" for scroll up and "↓" for scroll down. When selecting one of these keypads, an audible signal is heard by the user. The display screen can be switched to display a main menu by pressing keypad $\mathbf{270}_1$ ("M") , which menu may consist of, for example, the following submenu:

1. Registration
2. Insurance Records
3. Inspection Records
4. Maintenance Records
5. Billing
6. Traffic Ticket Initially, submenu "1" is highlighted, but by using scroll keypad $\mathbf{270}_3$ ("↑") and/or keypad $\mathbf{270}_4$ ("↓"), other submenus may be accordingly highlighted. Pressing keypad $\mathbf{270}_2$ ("□") selects the highlighted submenu which then selectively queries electronic tag 115 for the corresponding vehicular records. Of course, portable interrogator 150 must be within the transmission range of electronic tag 115, but the vehicle may be either stationary or moving. Preferably, electronic tag 115 performs authentication, wherein the identity of portable interrogator 150 is confirmed as having authorization to receive the requested vehicular records, such as by using a pre-assigned 24-bit personal identification number (PIN). It is contemplated that other suitable authentication means known in the art may also be used, including the use of encryption algorithms.

To retrieve the registration records, submenu "1" is selected using keypad $\mathbf{270}_2$ ("□") which then queries or "pings" electronic tag 115 for the desired records. This information is retrieved from electronic tag 115 and, for example, displayed on the LCD 265 as:

| | |
|---|---|
| Owner: | John Rosa |
| Address: | 81 Main Street<br>Randolph, NJ |
| DOB: | 12/30/68 |
| License: | D2002 40676 12347 |
| License Plate No. MZX68Z9L | |

-continued

| | |
|---|---|
| State of New Jersey | |
| VIN: | JH4FUAS265I7CO22078 |
| Make: | 1998 Acura |
| Model: | 3.5 TL 4 DR. BEIGE |

To update this information, each field can be highlighted in sequence by pressing keypad $\mathbf{270}_2$ ("□") in a sequential fashion. Then using alphanumeric keypad 275, each field can be appropriately changed. Menu keypad $\mathbf{270}_1$ ("M") can then be pressed to exit, causing the updated records to be transmitted to electronic tag 115 and the appropriate vehicle base station for storage in control center 180. Inasmuch as the VIN, make and model of the vehicle are permanent identifiers of the vehicle, these records, however, cannot be modified.

In a like manner, the current insurance records for the vehicle can retrieved, displayed and, if desired, modified by selecting submenu "2" from the main menu. In this latter case, a typical display may look as follows:

| | |
|---|---|
| Insurance Co: | NJ Manufacturers Insurance Co. |
| Policy No.: | FA709698-8 |
| Effective Date: | Jun 20, 1997 |
| Expiration Date: | Jun 20, 1998 |

Select keypad $\mathbf{270}_2$ ("□") is used to highlight each field, with alphanumeric keypad 275 used to change the contents of each field. When the insurance records have been updated, keypad $\mathbf{270}_2$ ("□") is again pressed and then transmitted to control center 180 as well as to electronic tag 115.

Selecting submenu "3" and submenu "4" similarly retrieves and displays the inspection and maintenance records for the vehicle, respectively, as follows:

Submenu "3"

| | |
|---|---|
| Inspection Expiration Date | September 20, 1998 |
| Failed | None |
| Or | |
| Temporary Inspection Sticker Expires | September 1998 |
| Failed | Lights<br>Brakes<br>Exhaust |

Submenu "4"

Maintenance Records 12,000 Km Service Performed 9/97
24,000 Km Service Performed 6/98
Replaced Engine Oil
Reset Idle Speed
Adjusted front & Rear Brakes Again these latter records may be updated using alphanumeric keypad 275, as discussed herein above.

The "billing" submenu or submenu "5" is selected using likewise scroll up keypad $\mathbf{270}_3$ ("↑") and/or scroll down keypad $\mathbf{270}_4$ ("↓") in conjunction with select keypad $\mathbf{270}_2$ ("□"). Importantly, this feature affords the driver of the vehicle to pay on demand for services performed, or for any traffic violations issued by an officer. When selected, submenu "5" itself consists of another submenu having the following items:

1. Amexp
2. Visa
3. MasterCard
4. Bank Account

After selecting the appropriate submenu of the "billing" submenu, the account number for the corresponding credit card, bank account or ATM card, as well as the amount of the service or fine, is entered using alphanumeric keypad 275. This latter amount is then deducted from the driver's bank account or charged to the appropriated credit card. Returning to the main menu is effected using keypad $\mathbf{270}_1$ ("M"), causing the account number and the amount to be transmitted to control center 180 via vehicular base station 155 for processing through POS/ATM network 210.

One unique aspect of the present vehicular communication network is the ability of ticketing drivers for traffic violations without the need for an officer to manually approach a vehicle and obtain the registration records. After selecting the "traffic violation" menu or submenu "6", portable interrogator 150 queries electronic tag 115 for the registration records for the vehicle and then displays a standardized traffic ticket on LCD 265 obtained, for example, from control center 180 and populated with those records. An exemplary traffic ticket is shown below, with the retrieved registration records as well as the current date and time shown in bold.

| | | |
|---|---|---|
| Traffic Ticket No: LA124-56ASD | | |
| Last Name: | | |
| Number and Street: | | |
| City: | State: | Zip code |
| Motorist Identification Number: | | |
| Lic. State: | Lic: Class: | Date Expired: |
| Sex: | Date of Birth: | |
| Plate Number: MZX68Z9L | Reg. State: NJ | Color: Beige |
| VIN: JH4FUAS265I7CO22078 | Vehicle Year/Make: 1998 Acura 3.5TL | |
| Weekday: Monday | Date: 05/30/98 | Time: 9:10 AM |
| Street Name: | | |
| County: | State: | |
| In Violation of: | | |
| Description of Violation: | | |
| Officer Name: | | |

Likewise, select keypad $\mathbf{270}_2$ ("□") is used to highlight each field, with alphanumeric keypad 275 used to enter the missing information, including the nature of the traffic violation and the driver's name and address. When the traffic ticket has been completed, keypad $\mathbf{270}_2$ ("□") is again pressed and a record of the ticket transmitted to control center 210. If desired, the "billing" menu may be used for the driver to pay the fine, if pleading guilty to the offense charged.

Figure 8:
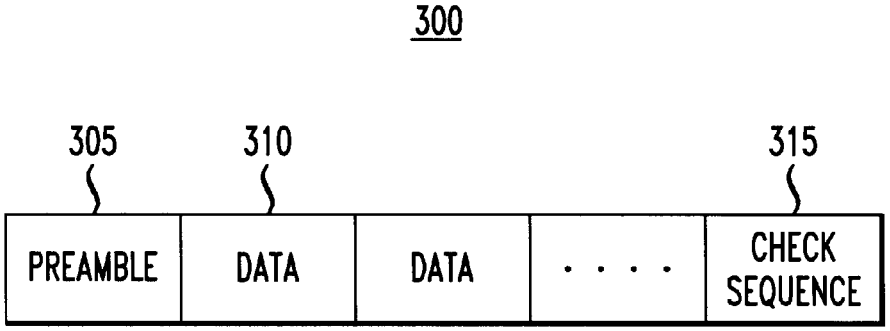
FIG. 8 is an illustrative data format for messages transmitted among the portable interrogator, electronic tag, vehicle base station and control center of the present vehicle communication network.

As shown in FIG. 8, it is contemplated that the message format for the records transmitted to portable interrogator 150, vehicle base station 155 and/or control center 180 may follow a general frame structure 300 having a preamble 305, one or more data words 310, and ending with a block code check sequence 315 for purposes of detecting error transmission. The size and number of data words in every message are made variable depending upon the size of the records transmitted.

It is contemplated that an 8-bit sequence after the preamble may be used, for example, to denote the type of request made by portable interrogator 150. If, for example, portable interrogator 150 initiates a request for registration records, the preamble may be followed by a bit sequence of 0000 0001 to denote that a registration request has been made. Similarly, other requests may each have a unique bit sequence as follows:

| | |
|---|---|
| 0000 0001 | Registration |
| 0000 0010 | Records for Insurance |
| 0000 0011 | Records for Inspection |
| 0000 0100 | Records for Maintenance |
| 0000 0101 | Records for Traffic Violations |

Additionally, bit sequences may be used to designate commands, such as a request for the billing of, or updating for particular records.

In general, an application-oriented protocol is used to coordinate the activities between the electronic tags and portable interrogator 150 to ensure common syntax semantics for the transmitted records. For example, the application-oriental protocol may specify a particular type of encoding for vehicular identification data as well as the origination of such information with a message. The application-oriented protocol formats the messages and transmits the records to portable interrogator 150. As discussed herein above, electronic tag 115 may transmit, for example, registration, insurance, inspection and/or maintenance records for the vehicle, or, in general, data associated with the identification of the vehicle. Record management is then effected by control center 180 after portable interrogator 150 has selectively transmitted the desired records.

Figure 9A:
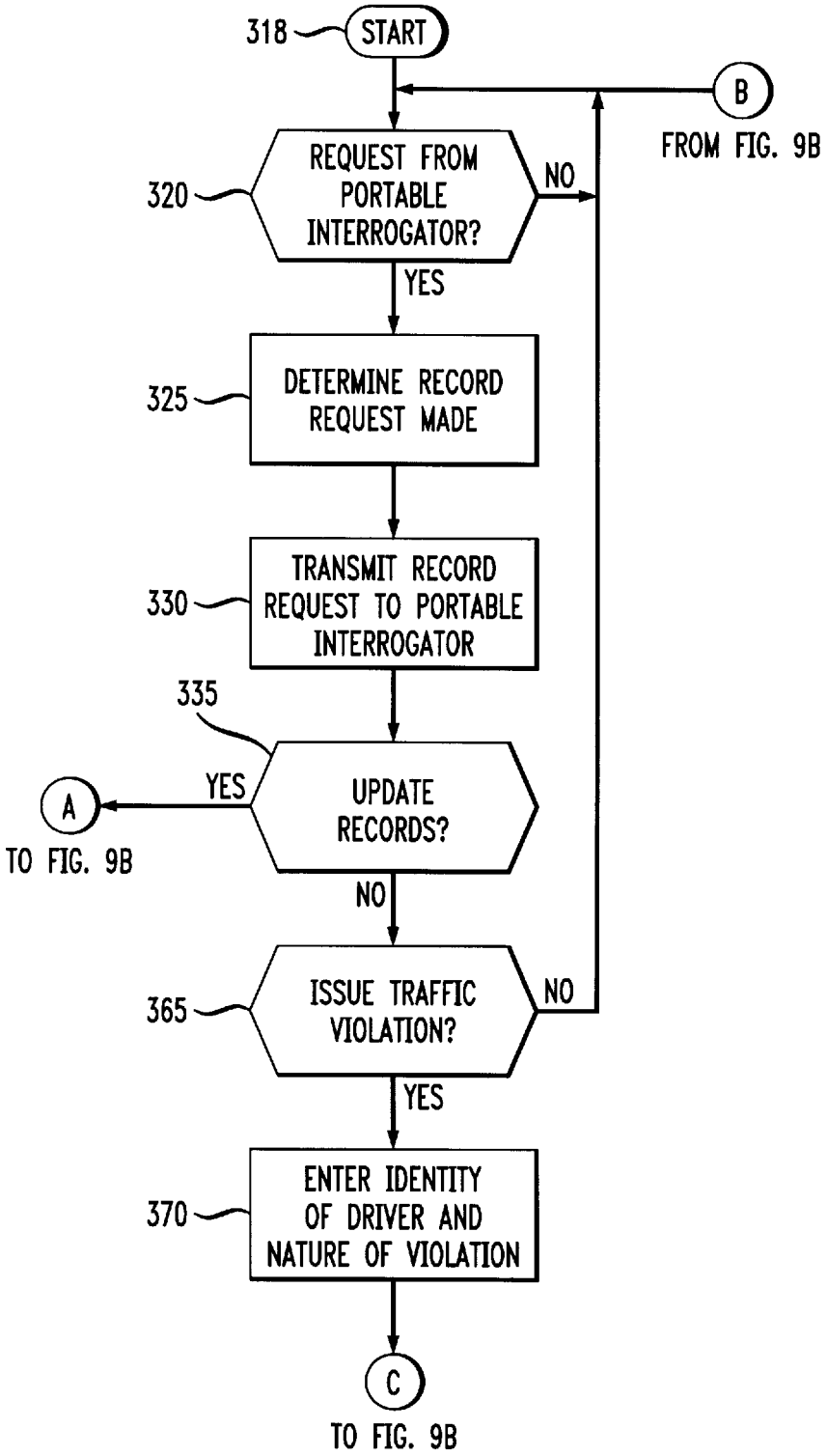
FIGS. 9A–9B depict a flow chart illustrating the operation of the portable interrogator and electronic tag of FIG. 1.
Figure 9B:
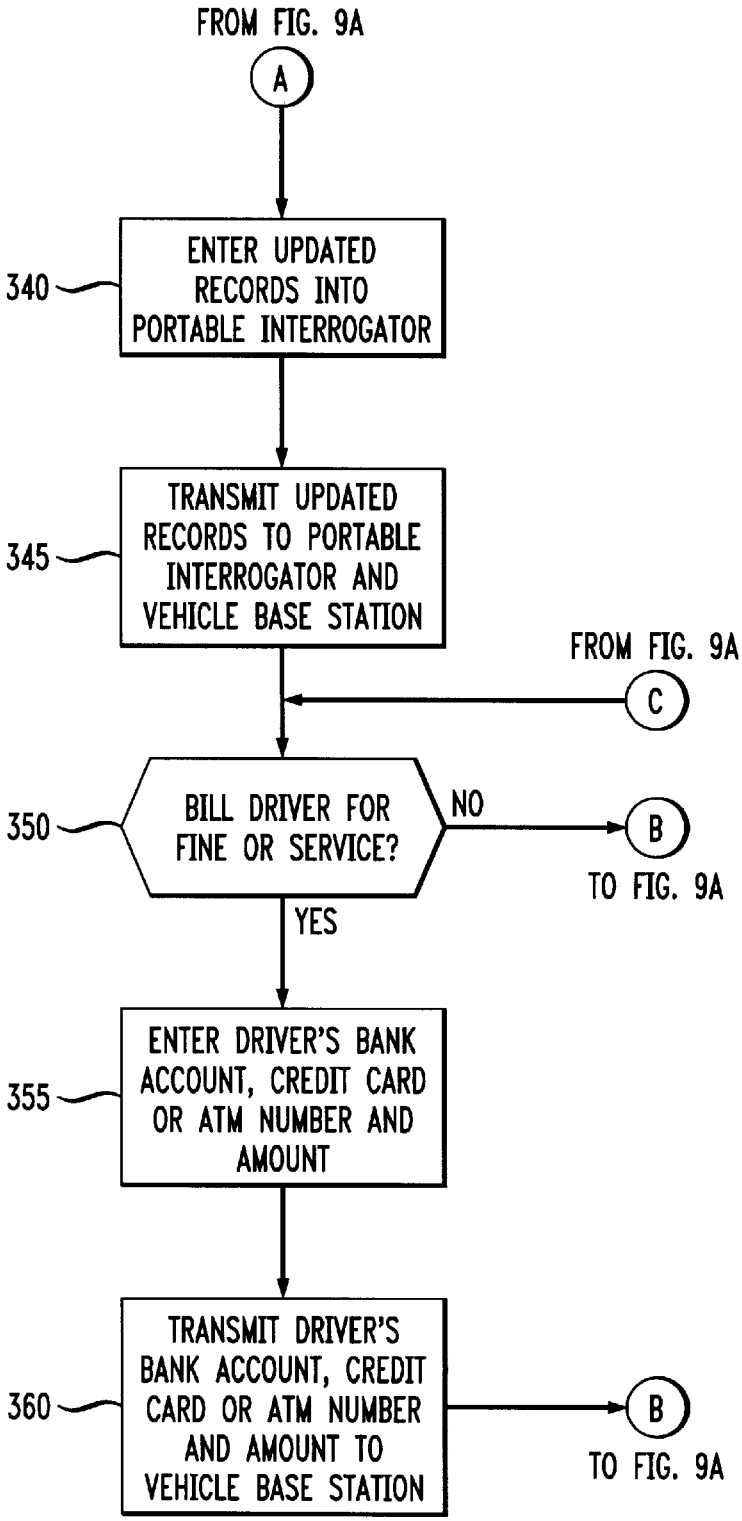

Shown in FIGS. 9A–B is a flow chart illustrating a simplified communication protocol between electronic tag 115 and portable interrogator 150. This communication protocol may be readily implemented by microprocessor 130 and microprocessor 245 residing within electronic tag 115 and portable interrogator 150, respectively. Briefly, the flow chart includes a sequence of generally repetitive instructions arranged in a loop until electronic tag 115 is queried, wherein the flowchart then branches to an appropriate point to retrieve or store the desired vehicular records.

More specifically, at start (block 318), control passes to block 320 which determines whether electronic tag 115 has been queried by portable interrogator 150. If a query has been initialized, control passes to block 325 to effect retrieval of the desired records in response to signals from portable interrogator 150. Block 325 determines which records portable interrogator 150 has requested, and then transmits the appropriate records to portable interrogator 150 at block 330. Otherwise, block 335 determines whether updated vehicular records need to be entered into electronic tag 115. If so, at block 340 the updated records are appropriately entered and transmitted to electronic tag 115 and vehicle base station 155 at block 345.

If no records need to be updated, then block 365 determines whether to issue a traffic ticket, with the identify of the driver and nature of the violation then entered at block 370. Block 350 then determines whether the driver is to be billed for any services or traffic fines. If so, the driver is requested to enter a valid credit card, bank or ATM account number, as well as the amount, using portable interrogator 150 at block 355. This latter information is then transmitted to vehicle base station 155 for control center 180 to debit the driver's bank account or credit card number via POS/ATM data communication network 205 at block 360.

Figure 10:
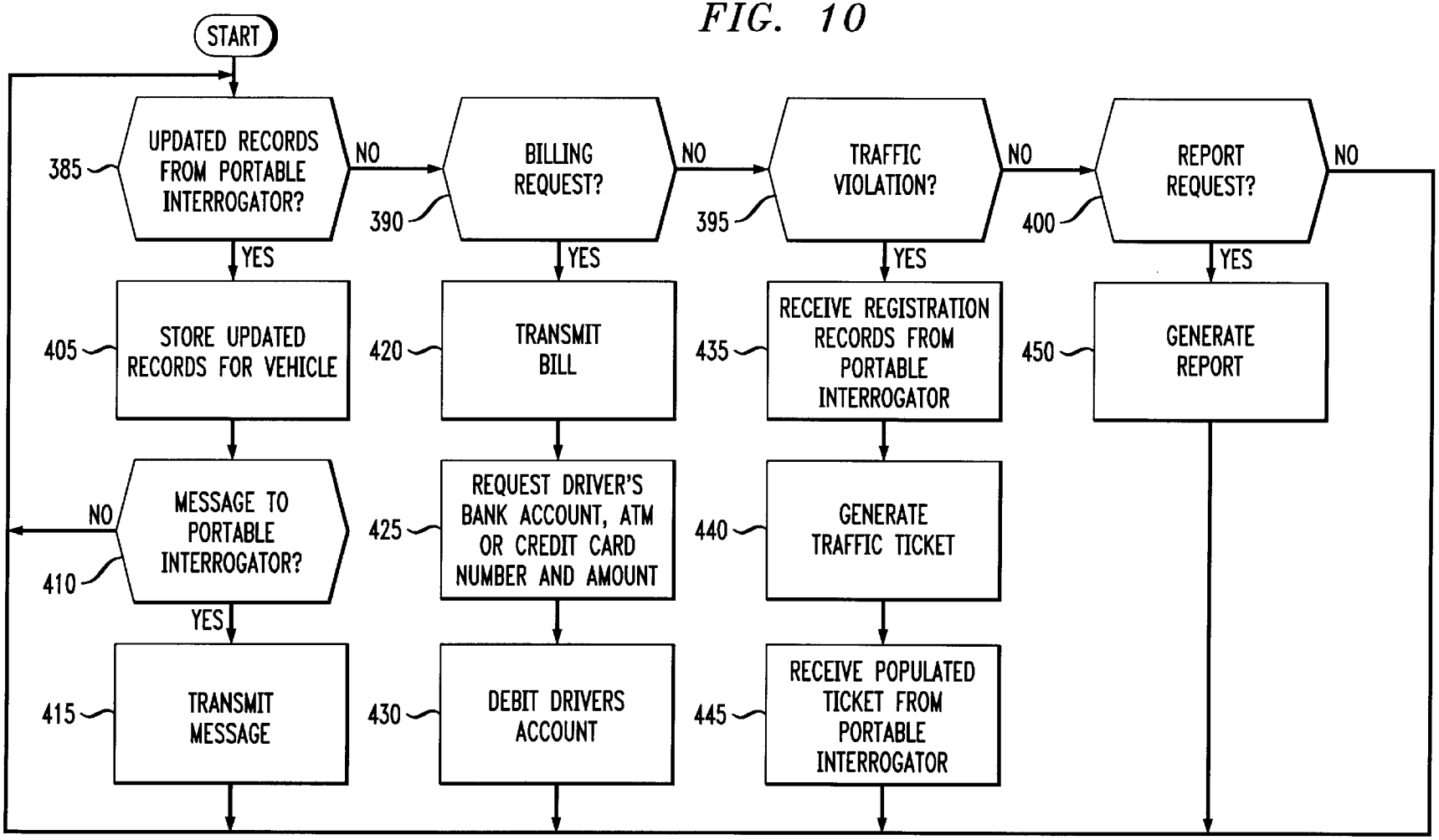
FIGS. 10A–10B depict a flow chart illustrating the operation of the control center of FIG. 1.

Referring now to FIGS. 10A–B, the generalized operation of the control center 180 is illustrated. FIGS. 10A–B show the manner in which control center 180 in the present embodiment effects record management and collection. It should be understood that control center 180 includes updated inspection, insurance, and/or registration records which may have been received from electronic tag 115 via portable interrogator 150 and vehicle base station 155. Integrated with this function is the system's capability to bill the driver for the corresponding service, such as for maintenance, traffic violations, and/or registration renewal.

Normally, data from vehicular base station 155 consists of four different types: updated records, billing requests, traffic violation, or reports. At decision blocks 385, 390, 395 and 400, control center 210 determines which type of request it is. Block 385 checks for updated records. If, in decision block 385, updated records has been received from vehicle base station 155, control then passes to block 405 which appropriately stores the updated records for the corresponding vehicle.

Those skilled in the art will readily note that the network system of the present invention allows the control center to effect record management and collection located over wide geographical areas. If the updated records, however, are invalid, control center 180 may communicate and display on the display of portable interrogator 150 a suitable message to that effect at blocks 410 and 415. If desired, control center 180 may be programmed to check its internal database to identify stolen vehicles or those used in the commission of a crime. Likewise, a suitable message may be transmitted to portable interrogator 150 at block 415 via the appropriate vehicle base station. Alternatively, control center 180 may alert the local law enforcement agency to dispatch a patrol car to the location of the stolen vehicle.

It is contemplated that control center 180 may also effect collection, such as for registration renewals, maintenance and/or traffic violations. According to the preferred embodiment, control center 180 determines at block 390 whether a billing request has been made. If billing has been requested, control center 180 prepares and transmits at block 420 an appropriate invoice or bill to portable interrogator 150. At block 425, the driver then may enter his or her bank account or credit card number and the amount into portable interrogator 150, thereby authorizing funds to be transferred from the driver's financial institution. Alternatively, the driver's signature may be digitalized and captured using portable interrogator 150 adapted to accept such a signature. Upon approval, control center 180 at block 430 initiates a transfer of funds from the driver's financial institution.

Alternatively, inasmuch as portable interrogator 150 contains the necessary records to effect collection, the invoice may be prepared by portable interrogator 150. In this latter case, portable interrogator 150 is embedded in memory with a standard billing format or invoice. Once prepared, the billing records may be transmitted to control center 180. In this manner, collection may be distributed or off loaded to portable interrogator 150. Of course, those skilled in the art will readily realize that vehicle base stations 155 may also be programmed to effect collection. These latter choices are dependent on whether the network is structured as a highly centralized or distributed architecture.

It should be clearly understood that one uniqueness of the present vehicular communication network is that a law enforcement officer may stop a vehicle and obtain the registration records of the vehicle without the need of leaving the safety of his car. If desired, the officer may then proceed to issue a traffic ticket at block 395. To do so, the registration records of the vehicle are transmitted to control center 180 at block 435, which then prepares using a standardized format a traffic ticket. Of course, additional information is provided to the control center, such as the identify of the driver, and the type and nature of the traffic violation, which may be entered through portable interrogator 150. A populated traffic ticket is then transmitted to control center 180 at blocks 440, 445. If desired, the driver may plead guilty to the offense charged, with control center 180 debiting the driver's bank account or credit card in a similar manner as discussed above herein.

Importantly, control center 180 includes database 200 containing registration, inspection, insurance, and/or maintenance records. Advantageously, this allows control center operators to update those records for a particular vehicle and later transmit such records to electronic tag 115 when the vehicle is taken, for example, to an authorized center. Also, control personnel may request at block 400 for center 180 to generate or prepare various records for a specific vehicle. Notices, such as for expired registration, insurance and/or inspection, may be generated and mailed to individuals. Such capabilities enhance record management as well as minimize the amount of work performed by service personnel on administrative tasks. Database management software running under UNIX may be employed in control center 180, which is readily capable of implementation by those skilled in the art.

It should be emphasized that the above described flow charts are merely examples of the how the system may be programmed in order to effect record management and collection. Other application-specific software may readily be realized by those skilled in the art and who have been equipped with the understanding of the operation of the present invention as set forth in the above description.

Accordingly, it should be understood that the embodiment herein is merely illustrative of the principles of the invention. Various modifications may be made by those skilled in the art which will embody the principles of the invention and fall within the spirit and the scope thereof. For example, in the embodiments above, record management and collection is provided and coordinated through a centralized control center. It should, however, be clearly understood that some of these services may be distributed or off loaded to the vehicle base stations which may be programmed to effect these latter services. The choice is dependent on whether the network is structured as a highly centralized or distributed architecture.

What is claimed is:

1. A communication network for integrating record management and collection for vehicles located over a geographical area that is divided into a plurality of radio coverage areas or cells, comprising:

a plurality of electronic tags installed in each of said vehicles, each of said plurality of electronic tags including first wireless means for selectively transmitting and receiving vehicular data for an associated vehicle in response to radio frequency signals, each of said plurality of electronic tags having static and dynamic memories for storing permanent and variable vehicular data;

at least one portable interrogator including second wireless means for communicating with and querying said plurality of electronic tags so as to selectively update, transmit, and retrieve vehicular data in said dynamic memory, each of said plurality of electronic tags also having means in response to a specific query from said at least one portable interrogator for selectively transmitting to and receiving from said at least one portable interrogator only desired vehicular data stored in said static and dynamic memories for the associated vehicles of said plurality of electronic tags;

a plurality of vehicle base stations, each associated with one of said plurality of radio coverage areas or cells, said vehicle base stations each including third wireless means for receiving and transmitting vehicular data from said at least one portable interrogator obtained from said electronic tags when said at least one portable interrogator is within the radio coverage area or cell of the corresponding vehicle base station; and a control center coupled through data links to said plurality of vehicle base stations for establishing communication with said at least one portable interrogator through the corresponding vehicle base station associated with the location of said least portable interrogator for processing vehicular data received from said plurality of vehicle base stations so as to effect record management and collection for the vehicular data contained within the electronic tags of the associated vehicles.

2. The communication network of claim 1 wherein said data links are wireless data links.

3. The communication network of claim 1 wherein said first, second and third wireless means each includes a RF transmitter and receiver.

4. The communication network of claim 1 wherein each of said plurality of electronic tags includes memory for storing the vehicular data.

5. The communication network of claim 1 further comprising point of sale means for debiting a driver's financial account.

6. The communication network of claim 1 further including a database containing registration, inspection, insurance or maintenance records for the vehicles.

7. The communication network of claim 6 wherein said database is resident in said control center.

8. The communication network of claim 1 wherein each of said plurality of vehicle base stations is associated with a radio coverage area or cell, such that said at least one portable interrogator communicates with a corresponding vehicle base station and vehicles located within the same cell.

9. The communication network of claim 1 wherein said control center means includes an integrated system digital network (ISDN) interconnecting said plurality of vehicle base stations.

10. The communication network of claim 1 wherein the vehicular data includes traffic violations.

11. The communication network of claim 1 wherein said at least one portable interrogator includes a display for displaying the vehicular data.

12. The communication network of claim 1 wherein said at least one portable interrogator includes keypads for selecting the vehicular data to be retrieved from the electronic tag of a desired vehicle.

13. The communication network of claim 12 wherein said vehicular data is selected in a menu driven manner.

14. The communication network of claim 1 wherein said at least one portable interrogator includes means for updating the vehicular data associated with a desired vehicle.

15. The communication network of claim 14 wherein said means for updating includes an alphanumeric keypad.

16. The communication network of claim 15 wherein the updated vehicular data is transmitted to one of said plurality of electronic tags associated with a desired vehicle.

17. A communication system for managing vehicular records for vehicles located over a geographical area that is divided into a plurality of radio coverage areas or cells, comprising:

a control center having a database for storing vehicular records;

vehicle base stations, each associated with one of said plurality of radio coverage areas or cells;

communication links interconnecting said vehicle base stations to said control center, each of said vehicle base station including means for transmitting and receiving vehicular records to and from said control center; and bidirectional wireless communication links including a portable interrogator interconnecting said vehicle base stations with electronic tags installed on vehicles, said portable interrogator including first wireless means for selectively receiving and transmitting vehicular data between said electronic tags and a corresponding vehicle base station associated with the radio coverage area or cell that the portable interrogator resides within, and each of said electronic tags having static and dynamic memories for storing permanent and variable vehicular data, and having second wireless means for selectively transmitting and receiving vehicular data for an associated vehicle in response to radio frequency signals from said portable interrogator.

18. The communication system of claim 17 wherein each of said electronic tags include wireless means for transmitting and receiving vehicular records for an associated vehicle in response to an query from said portable interrogator.

19. The communication system of claim 17 wherein each of said electronic tags includes memory for storing vehicular records.

20. The communication system of claim 17 further comprising point of sale means for debiting a driver's financial account.

21. The communication system of claim 17 wherein said vehicle base station is associated with a radio coverage area, such that said wireless communication link is established with said vehicle base station and vehicles located within the radio coverage area.

22. The communication system of claim 17 wherein the vehicular data includes traffic violations.

23. The communication system of claim 17 wherein said portable interrogator includes a display for displaying the vehicular records.

24. The communication system of claim 17 wherein said portable interrogator includes keypads for selecting the vehicular records to be retrieved from the electronic tag of a desired vehicle.

25. The communication system of claim 24 wherein said vehicular records are selected in a menu driven manner.

26. The communication system of claim 17 wherein said portable interrogator includes means for updating the vehicular records associated with a desired vehicle.

27. The communication system of claim 26 wherein said means for updating includes an alphanumeric keypad.

28. The communication system of claim 26 wherein the updated vehicular data is transmitted to one of said electronic tags.

29. A method of managing records for vehicles equipped with electronic tags that transmit data associated with the vehicles over a radio communication link, comprising the steps of:

interconnecting vehicle base stations with a control center, said vehicle base stations each associated with a predetermined radio coverage area;

using a portable interrogator, selectively querying and retrieving from said electronic tags vehicular records for desired vehicles, said electronic tags having static and dynamic memories for storing permanent and variable vehicular data;

using said portable interrogator, selectively transmitting updated vehicular data to said electronic tags;

transmitting retrieved vehicular records from said electronic tags to a corresponding vehicle base station associated with the radio coverage area that the portable interrogator is located within; and using said portable interrogator, selectively updating, if necessary, the vehicular records and then selectively transmitting the vehicular records to said electronic tags and the control center for record management through the corresponding vehicle base station associated with the radio coverage area that the portable interrogator is located within.

30. The method of claim 29 further comprising the step of debiting a driver's financial account for funds corresponding to the transactional fees for processing the vehicular records.

31. The method of claim 29 further comprising storing vehicular data in said electronic tags associated with the corresponding vehicles.

32. The method of claim 29 wherein the vehicular data includes registration, inspection, insurance or maintenance records.

33. The method of claim 29 wherein the vehicular data includes traffic violations.

34. The method of claim 29 further comprising the step of displaying the vehicular data on said portable interrogator.

35. The method of claim 29 further comprising the step of selecting the vehicular data to be retrieved from the electronic tag of a desired vehicle.

36. The method of claim 29 further comprising the step of updating the vehicular data in said electronic tags.

* * * * *